US005087528A

United States Patent [19]

Bock

[11] Patent Number: 5,087,528

[45] Date of Patent: Feb. 11, 1992

[54] FASHION ARTICLE

[75] Inventor: Juergen Bock, Pforzheim, Fed. Rep. of Germany

[73] Assignee: Bock and Schupp GmbH & Co. KG, Zifferbläfter-Fabrik, Pforzheim, Fed. Rep. of Germany

[21] Appl. No.: 367,884

[22] Filed: Jun. 19, 1989

[51] Int. Cl.[5] ..... A44C 25/00; G02B 5/08

[52] U.S. Cl. ..... 428/542.4; 428/700; 428/912.2

[58] Field of Search ..... 428/542.4, 472.2, 457, 428/700, 912.2

[56] References Cited

U.S. PATENT DOCUMENTS

| | | | |
|---|---|---|---|
| 1,891,248 | 12/1932 | Stamer | 428/187 X |
| 3,414,434 | 12/1968 | Manasevit | 428/700 X |
| 3,861,990 | 1/1975 | Kasai et al. | 428/49 X |
| 3,922,475 | 11/1975 | Manasevit | 428/700 |
| 3,950,596 | 4/1976 | Carr et al. | 428/700 |
| 4,292,374 | 9/1981 | Nishizawa et al. | 428/700 X |
| 4,835,061 | 5/1989 | Ohta et al. | 428/472.2 X |
| 4,849,299 | 7/1989 | Loth | 428/472.2 X |

*Primary Examiner*—Henry F. Epstein

[57] ABSTRACT

A wafer-like metallic fashion article particularly fashion jewelry, a tag, a medal or watch dial which consists of a single crystal member provided on one or both of its sides with a material layer that is different from the wafer material and of 0.01 to 2 μm thickness.

7 Claims, 1 Drawing Sheet

FASHION ARTICLE

BACKGROUND OF THE INVENTION

The invention relates to a disc or wafer-like metallic fashion article such as jewelry, a tag, a medal or a watch dial, which is treated on one or both sides.

Such disc-shaped metallic fashion articles are in wide use in the manufacture of jewelry. These fashion articles may be worn alone, for example, as ear pendants, or they may be part of a jewelry creation, for example, a necklace or a bracelet. The surfaces of these metallic wafer-like jewelry pieces are treated in various ways such that these discs or wafers have either plain or smooth, mirror-like, polished or patterned surfaces. The material used for such articles may be any type of metal from aluminum to precious metals. The precious metals, particularly silver and gold, are usually maintained so as to show their colors. Aluminum however is generally subjected to an anodic treatment to provide for various surface colorings. The same is true with regard to galvanic treatment of titanium. If mirror-like treated surfaces with a roughness (peak-to-valley height) of less than 1 μm are disired, metals with hard surfaces are utilized, that is, generally surface-hardened metals which retain the mirror-like brilliance over a long period of time. Such hard materials, that is, for example, carbides, nitrides, borides and silicides, however are relatively difficult to work. Jewelry of such materials is therefore relatively expensive and therefore not competitive when compared with jewelry of precious metals of about the same price.

However mirror-like metal surfaces with a roughness of 1 μm as indicated above have optical properties which are of particular interest in connection with jewelry. The properties which cause the articles to become desirable jewelry pieces may be enhanced by additional surface treatment, for example, by providing a surface pattern or by coatings which achieve additional optical effects.

It is therefore the principal object of the present invention to provide a wafer-like article for use in jewelry, particularly in fashion jewelry which is relatively inexpensive, and which has a hard surface but nevertheless can be worked or treated by means known to a material expert in such a manner that unusual and interesting optical effects are obtained.

SUMMARY OF THE INVENTION

A wafer-like metallic fashion article, particularly a piece of fashion jewelry, a tag, a pendant, a medal or a watch dial is made of a single-crystal wafer which is provided on one or both of its sides with a layer of a material that is different from the material of the wafer and of a thickness of 0.01 to 2 μm so as to provide for special fascinating light effects.

The use of single crystals would appear to be contradictory to the requirement that such a jewelry piece should be inexpensive. However single crystals have special properties which facilitate working of such disc or wafer-shaped metallic jewelry pieces thereby reducing expenses, and in the mean-time they are being used in large quantities and are therefore manufactured in large volumes and relatively inexpensively.

In contrast to a polycrystal member a single crystal is a crystalline body whose basic cells are disposed almost in parallel and which does not exhibit any grain boundary. This property may be utilized in the manufacture of such jewelry pieces by having the plane of the disc or wafer-like jewelry piece coincide with the crystal plane. Then incident light is always reflected in the desired manner at the same angle, whereas with a polycrystal body each crystal or grain reflects the light in a different direction. The desired mirror-like surfaces are therefore obtained very easily and they have only a relatively small peak-to-valley height when compared with polycrystals or amorphous metals. The peak-to-valley height of such single crystal pieces may well be in the nano meter range, down to about 5 nm. However, even surfaces with substantially larger peak-to-valley heights, for example, 200 nm, are still perfectly reflective to the observer because of the effect described above. As a result, the somewhat higher manufacturing cost for single crystals are compensated for during the working of the jewelry pieces which additionally provide for optical effects which cannot be achieved with bodies of polycrystalline material.

As already mentioned the price of those materials has come down since such single crystals, especially silicon crystals, are utilized in large quantities and furthermore the "silicon wafers" are already present in flat plate or disc form. Since the sides of the wafers are in parallel planes which also represent the crystal planes, it is quite easy to treat or work both sides of such a silicon wafer without loss in quality.

It is further possible to provide a pattern on the surfaces of such single crystal wafers by way of methods which are well known to the experts in the field. These methods are generally used in the manufacture of electronic components, that is, they are in wide use in the industry so that they are not only well known and common but also inexpensive, especially when utilized for the manufacture of large numbers.

Already the reflective disc-shaped single crystals have a relatively high decorative value. However this decorative value is enhanced if in accordance with the invention the single crystals are provided on one or both sides with one or more smooth or patterned layers of a chemically different material of a thickness of 0.01 μm to 2 μm. It is well known that extremely thin coatings or layers of less than 2 μm thickness have special properties. This is probably the result of a rapid increase of the refraction index and at the same time a decrease of the absorption coefficient with decreasing thickness of the layer. Caused by multiple reflections on the surface of the thin layer as well as at the crystal surface there occur interferences which provide remarkable optical effects.

In any case, such extremely thin layers generate special optical effects which make those discs or plates especially desirable in the manufacture of jewelry. It has been found that layers with thicknesses of 0.05 to 2 μm exposed to daylight of an average wavelength of 0.545 μm generate various colors from metallic dark blue to dark red over the whole color spectrum. It is therefore possible to determine the desired color of the disc-like metallic jewelry component by providing for the appropriate thickness of the coating. A predetermined color however is achievable only if the base, that is, the surface of the crystal wafer, has a surface with a small peak-to-valley height as they are present on single crystal surfaces as explained before. The peak-to-valley height should be smaller than the coating thickness by the power of ten, which coating is utilized to generate the color to be noticed by the human eye.

The chemically different layer which in accordance with the invention is disposed on the single crystal may consist of a metal or a metal compound. In any case, the metal or metal compound should have a high complex refraction index which is generally the case for the hard materials mentioned earlier: carbides, nitrides, borides and silicides. It also is true for semiconductor materials, especially silicon which is of particular interest in this connection.

Of the metal compounds those are preferred which develop a hard surface, that is, compounds which include nitrogen, oxygen, boron or carbon. But here too an inexpensive manufacturing capability is important and oxygen and nitrogen are therefore the preferred components for the compound. A very simple and inexpensive generation of such a chemically different coating or surface layer is obtained by directly oxidizing or nitriding one or both sides of the single crystal. With well known processes, for example, by treatment in a through-type oven, the depth of penetration of the oxygen or the nitrogen and accordingly the thickness of the layer which is responsible for its color reflection can be accurately controlled.

It is also possible to form a layer by the well-known Deposition processes: Chemical Vapor Deposition (CVD), Low Pressure CVD (LPCVD), Plasma Enhanced CVD (PECVD), Normal Pressure CVD (NPCVD). It is further possible to combine the processes by, for example, first oxidizing the single crystal then providing a pattern by way of etching and then depositing an additional layer which may also be provided with a pattern, or which may cover only predetermined areas of the disc-like single crystal. It is also possible to employ the oxidation process and the nitration process one after the other wherein for example after the oxidation step the oxide layer is partially removed and the so exposed silicon surface is then nitrided. It is furthermore possible to deposit on the so treated discs or wafers additional layers or to print on them or to deposit precious metal in the surface depressions. Of course protruding surface areas may also be provided in this manner. A combination of these methods in various manners makes it possible to achieve special optical effects which cannot be achieved with regular surface treatments. Projections and depressions may be simulated, holograms may be formed on such surfaces and different surface areas may furthermore be formed so as to provide various colors.

It should also be noted that by nitriding or oxidizing the surfaces they become hard and scratch resistant in a simple manner which is highly desirable; in fact they have a scratch hardness number of above 8 (Martens).

All together there is provided a disc or plate-shaped metallic jewelry component which is reasonably inexpensive and which may be manufactured with equipment in wide use by the experts in the field. Such a jewelry component has a hard surface and therefore is scratch resistant and furhermore has desirable optical effects not known heretofore.

BRIEF DESCRIPTION OF THE DRAWINGS

The drawings illustrate schematically certain embodiments of the invention.

DESCRIPTION OF THE PREFERRED EMBODIMENTS

Figure 1:
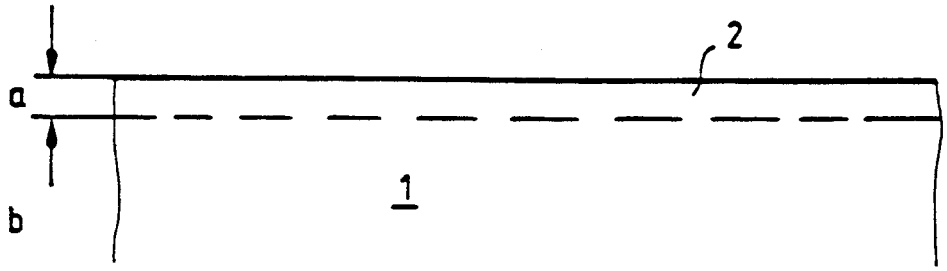
FIG. 1 shows a single crystal with oxidized surface.

FIG. 1 shows a single crystal portion 1 which has been oxidized so as to have an oxide coating 2 of a thickness a of 0.01 μm to 2 μm by which the optical effects and color reflections described earlier are achieved. The thickness b of the single crystal wafer is generally about 500 μm. The oxidation layer 2 also provides for a high surface hardness such that the metallic wafer 1 is highly scratch resistant.

Figure 2:
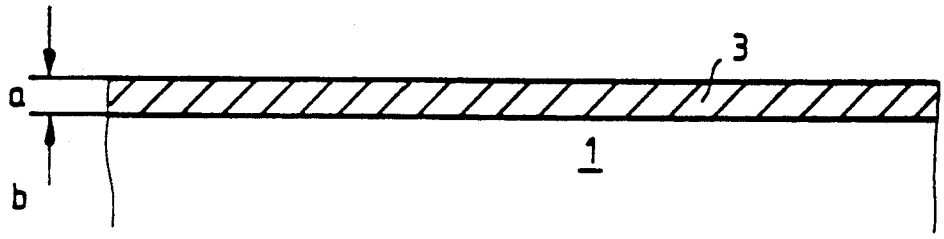
FIG. 2 shows a single crystal with a surface layer deposited thereon.

In the arrangement of FIG. 2 a metal or metal compound layer 3, again of a thickness a of 0.01 μm to 2 μm is disposed on a polished single crystal wafer 1 preferably by a chemical vapor deposition process. This layer is generally diffused to some extent into the silicon single crystal wafer surface, that is, it is firmly associated with the single crystal. The layer 3 will also generate a hardening of the surface in addition to providing the special color effects.

Figure 3:
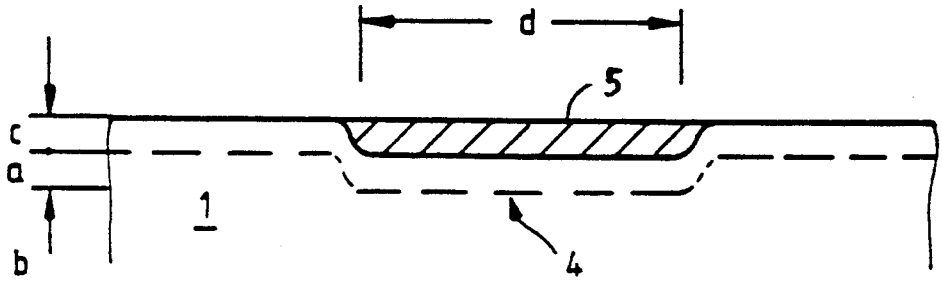
FIGS. 3 and 4 illustrate combinations of the arrangements of FIGS. 1 and 2.

In the arrangement according to FIG. 3 the silicon single crystal is first provided with a depression 4 by etching and, in accordance with the process of FIG. 1, is then oxidized providing a coating of a thickness a. The depression 4 which remains is then filled with an additional metal or metal compound layer 5 such that this area is different in color from the surrounding wafer surface. The thickness a of the coating layer is again between 0.01 and 2 μm, the thickness c of the layer 5 being in the same range. The smallest possible distance d between the edges of the depression area is 2 μm as a result of the etching process utilized.

Figure 4:
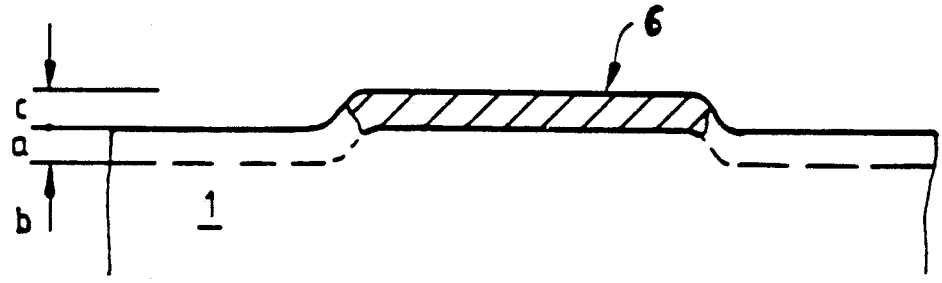

FIG. 4 shows a reversal of the arrangement of FIG. 3. In accordance with FIG. 4 the wafer is first etched in such a manner that the surface projections 6 remain which are then for example nitrided whereas the surrounding areas are oxidized. Also this process provides for special color effects which furthermore accentuate the projections.

It is finally pointed out that the anisotropic materials utilized in connection with the invention will produce various additional optical effects depending on the light incident angle.

What is claimed is:

1. A metallic fashion article which has opposite sides and is treated on at least one of its sides, said article comprising a flat single crystal member with a crystal plane coinciding essentially with a plane in which the flat single crystal member extends, said single crystal member carrying on at least one of its sides a layer consisting of a metal or metal compound material of 0.01 to 2 μm thickness thereby providing for light reflection from said article in colors depending on the thickness of said layer.

2. An article according to claim 1, wherein said single crystal member and said layer have flat and smooth surfaces.

3. An article according to claim 1, wherein said crystal member and said layer surfaces are patterned.

4. An article according to claim 1, wherein said metal or metal compound has a high complex refraction index.

5. An article according to claim 1, wherein said metal or metal compound consists of a semiconductor material.

6. An article according to claim 1, wherein said metal compound includes one of the elements oxygen and nitrogen.

7. An article according to claim 6, wherein said single crystal member is provided with an oxide or nitride coating.

* * * * *